US011370148B2

(12) United States Patent
Hernandez et al.

(10) Patent No.: US 11,370,148 B2
(45) Date of Patent: Jun. 28, 2022

(54) VOLUMETRIC MOBILE POWDER MIXER

(71) Applicant: EAGLE STRONG INVESTMENTS, LLC, Henderson, CO (US)

(72) Inventors: Douglas Alex Hernandez, Fort Morgan, CO (US); Stanley R. Peters, Castle Rock, CO (US)

(73) Assignee: Eagle Strong Investments, LLC, Henderson, CO (US)

( * ) Notice: Subject to any disclaimer, the term of this patent is extended or adjusted under 35 U.S.C. 154(b) by 0 days.

(21) Appl. No.: 16/777,581

(22) Filed: Jan. 30, 2020

(65) Prior Publication Data

US 2020/0164543 A1 May 28, 2020

Related U.S. Application Data

(63) Continuation of application No. 15/272,204, filed on Sep. 21, 2016, now Pat. No. 10,583,581.

(60) Provisional application No. 62/285,524, filed on Nov. 2, 2015, provisional application No. 62/284,064, filed on Sep. 21, 2015.

(51) Int. Cl.

| | |
|---|---|
| ***B28C 5/42*** | (2006.01) |
| ***B28C 7/04*** | (2006.01) |
| ***B01F 15/00*** | (2006.01) |
| ***B28C 5/38*** | (2006.01) |

(Continued)

(52) U.S. Cl.

CPC ..... *B28C 7/0418* (2013.01); *B28C 5/386* (2013.01); *B28C 9/0463* (2013.01)

(58) Field of Classification Search

CPC ..... B28C 5/381; B28C 5/383; B28C 5/386; B28C 5/388; E01C 2301/50

See application file for complete search history.

(56) References Cited

U.S. PATENT DOCUMENTS

| | | | |
|---|---|---|---|
| 69,611 A | 10/1867 | Ballard | |
| 430,575 A | 6/1890 | Griffin | |

(Continued)

FOREIGN PATENT DOCUMENTS

| | | | |
|---|---|---|---|
| EP | 1103533 A2 * | 5/2001 | ..... B28C 5/381 |
| GB | 2158491 | 5/1985 | |

OTHER PUBLICATIONS

ConcreteProducts.com, "Mixer measures up to grout, flowable fill production", Aug. 2018, 1 page.

(Continued)

*Primary Examiner* — Elizabeth Insler

(74) *Attorney, Agent, or Firm* — Merchant & Gould P.C.

(57) ABSTRACT

This disclosure describes volumetric mobile powder mixer (VMPM) systems and methods for VMPM operation and use. The VMPM is providing with a number of storage compartments (or bins) for liquid or solid ingredients including at least one powder storage bin, a powder transport system, a dust handling system, a solid/liquid mixing system, a cellular foam generator, a product delivery system, and a controller capable of monitoring the delivery and mixing of each of the ingredients, as well as the discharge of the final product. The controller determines if the proper mixture is being discharged by the VMPM and, if not, alerts the VMPM operator. In an automated embodiment, the VMPM controller is also configured to independently control the delivery and mixing of each of the ingredients, as well as the delivery of the final product.

19 Claims, 6 Drawing Sheets

(51) Int. Cl.
*B28C 7/00* (2006.01)
*B28C 9/04* (2006.01)

(56) References Cited

U.S. PATENT DOCUMENTS

| | | | | |
|---|---|---|---|---|
| 1,012,612 | A | | 12/1911 | Da Vier |
| 1,545,167 | A | | 7/1925 | Optiz |
| 3,024,930 | A | | 3/1962 | Sims |
| 3,043,200 | A | | 7/1962 | Huttash |
| 3,111,335 | A | | 11/1963 | Hickman |
| 3,130,652 | A | | 4/1964 | Newton, Sr. |
| 3,469,824 | A | | 9/1969 | Futty |
| 3,572,652 | A | | 3/1971 | Hale |
| 3,580,147 | A | | 5/1971 | Kaltenegger |
| 3,820,914 | A | | 6/1974 | Zimmerman |
| 4,036,564 | A | | 7/1977 | Richards |
| 4,085,976 | A | | 4/1978 | Edwards |
| 4,211,491 | A | | 7/1980 | Chaney |
| 4,437,766 | A | | 3/1984 | Joachim |
| 4,630,965 | A | | 12/1986 | Nguyen |
| 4,781,556 | A | | 11/1988 | Paul |
| 5,609,836 | A | | 3/1997 | McManus |
| 5,667,298 | A | * | 9/1997 | Musil ..... B28C 5/2018 366/17 |
| 5,795,060 | A | * | 8/1998 | Stephens ..... B01F 3/12 366/10 |
| 5,971,656 | A | | 10/1999 | Kitsmiller |
| 6,109,826 | A | | 8/2000 | Mertes |
| 6,290,428 | B1 | | 9/2001 | Hall |
| 6,439,806 | B1 | | 8/2002 | Dillingham |
| 6,942,717 | B2 | | 9/2005 | Armstrong |
| 7,080,955 | B2 | | 7/2006 | Gregg |
| 7,255,512 | B2 | | 8/2007 | Wallace |
| 7,410,322 | B1 | | 8/2008 | Wallace |
| 8,747,547 | B1 | | 6/2014 | Peters et al. |
| 8,882,905 | B1 | | 11/2014 | Peters et al. |
| 9,376,343 | B2 | | 6/2016 | Hernandez et al. |
| 9,486,938 | B2 | | 11/2016 | Pino |
| 9,816,237 | B2 | | 11/2017 | Loomis |
| 10,443,211 | B2 | | 10/2019 | Karam et al. |
| 10,571,045 | B2 | | 2/2020 | Pino, Jr. et al. |
| 10,571,047 | B2 | | 2/2020 | Pino, Jr. et al. |
| 10,583,581 | B2 | | 3/2020 | Hernandez |
| 10,641,414 | B2 | | 5/2020 | Pino, Jr. et al. |
| 11,168,460 | B1 | | 11/2021 | Karam |
| 11,173,630 | B1 | | 11/2021 | Karam |
| 2003/0142579 | A1 | | 7/2003 | Throop |
| 2007/0171764 | A1 | | 7/2007 | Klein |
| 2016/0138810 | A1 | | 5/2016 | Owen |
| 2016/0257620 | A1 | | 9/2016 | Peters et al. |
| 2017/0080601 | A1 | | 3/2017 | Hernandez |
| 2018/0038071 | A1 | | 2/2018 | Jurgens |
| 2018/0106015 | A1 | | 4/2018 | Pino et al. |
| 2018/0126592 | A1 | | 5/2018 | Karam |
| 2018/0156357 | A1 | | 6/2018 | Pino et al. |
| 2018/0313059 | A1 | | 11/2018 | Karam et al. |
| 2020/0149659 | A1 | | 5/2020 | Pino, Jr. et al. |
| 2020/0149660 | A1 | | 5/2020 | Pino, Jr. et al. |
| 2020/0200292 | A1 | | 6/2020 | Pino, Jr. et al. |
| 2020/0406501 | A1 | | 12/2020 | Hernandez |

OTHER PUBLICATIONS

Bay Lynx Website, "Bay-Lynx Develops Game-Changing Grout Mixer", found online at: https://bay-lynx.com/news/bay-lynx-develops-game-changing-grout-mixer/, May 15, 2018,4 pages.

* cited by examiner

VOLUMETRIC MOBILE POWDER MIXER

RELATED APPLICATIONS

This application is a continuation of U.S. patent application Ser. No. 15/272,204, filed Sep. 21, 2016, now U.S. Pat. No. 10,583,581, which claims the benefit of U.S. Provisional Application Nos. 62/284,064, filed Sep. 21, 2015, and 62/285,524, filed on Nov. 2, 2015, and which all applications are hereby incorporated by reference.

INTRODUCTION

A traditional volumetric mobile mixer (VMM), also known as volumetric concrete mixer and metered concrete truck, is a truck that contains concrete ingredients such as cement, aggregate materials and water to be mixed by the mixer at the job site to make and deliver concrete. As the construction industry has evolved, many new specialized concrete and cementious building material formulations that have been developed to meet different construction needs that use one more powder ingredients as well as cellular foam as an ingredient. For example, some formulations use fly ash to achieve a fast-setting high strength trench backfill for use in repairing trenched roadways. Other formulations use retarded cementitious formulations for culvert and pipe abandonment to ensure complete filling of the voids within the culvert or pipe. Such formulations may vary significantly depending on the application to achieve the final construction specifications needed. In addition, certain formulations may require liquid and aggregate ingredients that cannot be premixed and that must be mixed on site in specified proportions. Existing VMM designs are not capable of delivering many of these powder-based, foamed, cementious building material formulations that require one or more powder ingredients and/or cellular foam.

VOLUMETRIC MOBILE MIXER

This disclosure describes volumetric mobile powder mixer (VMPM) systems and methods for VMPM operation and use. The VMPM is provided with a number of storage compartments (or bins) for liquid or solid ingredients, a powder transport system, a dust handling system, a solid/liquid mixing system, a cellular foam generator, a product delivery system, and a controller capable of monitoring the delivery and mixing of each of the ingredients, as well as the discharge of the final product. The controller determines if the proper mixture is being discharged by the VMPM and, if not, alerts the VMPM operator. In an automated embodiment, the VMPM controller is also configured to independently control the delivery and mixing of each of the ingredients, as well as the delivery of the final product. The controller may be designed so that a specific formulation may be selected or input. The controller may also automatically initiate the operation of the various systems in the order and at the moment necessary to deliver the selected product.

This disclosure describes several different versions of a VMPM. In one version, the VMPM includes: a mobile platform; a mixing chamber having an inlet and an outlet; a first powder storage bin having an air slide that delivers a first powder to a first feed screw conveyor, wherein the first feed screw conveyors delivers first powder to the mixing chamber through the inlet; a second powder storage bin having an air slide that delivers a second powder to a second feed screw conveyor, wherein the second feed screw conveyors delivers second powder to the mixing chamber through the inlet; and a water storage tank that delivers water to one or more water injection nozzles spaced around the inlet that direct water into the mixing chamber. The VMPM may also include a first tachometer monitoring rotational speed of the first feed screw conveyor; and a second tachometer monitoring rotational speed of the second feed screw conveyor.

A delivery auger may be provided inside the mixing chamber that mixes powder and liquid delivered to the mixing chamber to generate a mixture and discharges the mixture from the outlet. The delivery auger may be a shaft with a helical screw blade (referred to as the flight or flighting) designed so that it has a first mixing screw section, a second mixing screw section, and a mixing paddle section between the first mixing screw section and the second mixing screw section, wherein the first and second mixing screw sections have different flight profiles.

The VMPM may further include a first flowmeter that outputs a first flow signal indicative of the instantaneous flow rate of water delivered into the mixing chamber; a dust handling system that maintains the mixing chamber, the first powder storage bin, and the second powder storage bin at a negative pressure relative to atmospheric pressure; and an air compressor.

The VMPM may further include a foaming agent storage tank; and a cellular foam generator. In one design, the cellular foam generator receives air from the air compressor, a cellular foam solution from the foaming agent storage tank, and water from the water storage tank and generates a flow of foam therefrom, wherein the cellular foam generator delivers the flow of foam to the mixing chamber at the location of the first screw conveyor section of the delivery auger, between the inlet and the mixing paddle section. The VMPM may further include a second flowmeter associated with the cellular foam generator that outputs a signal indicative of the instantaneous flow rate of foam delivered to the delivery auger.

The VMPM may further include a controller configured to: store a target formulation to be discharged by the volumetric mobile mixer; monitor operational parameters including at least the rotational speeds of the first and second feed screw conveyors, the flow rate of water delivered to the mixing chamber, and data indicative of the flow rate of foam delivered to the mixing chamber; calculate an estimated formulation of the product being discharged based on the monitored operational parameters; and display comparison information to an operator indicative of a comparison of the estimated formulation and the target formulation.

These and various other features as well as advantages which characterize the systems and methods described herein will be apparent from a reading of the following detailed description and a review of the associated drawings. Additional features are set forth in the description which follows, and in part will be apparent from the description, or may be learned by practice of the technology. The benefits and features of the technology will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The following drawing figures, which form a part of this application, are illustrative of described technology and are not meant to limit the scope of the invention as claimed in any manner, which scope shall be based on the claims appended hereto.

DETAILED DESCRIPTION

Figure 1A:
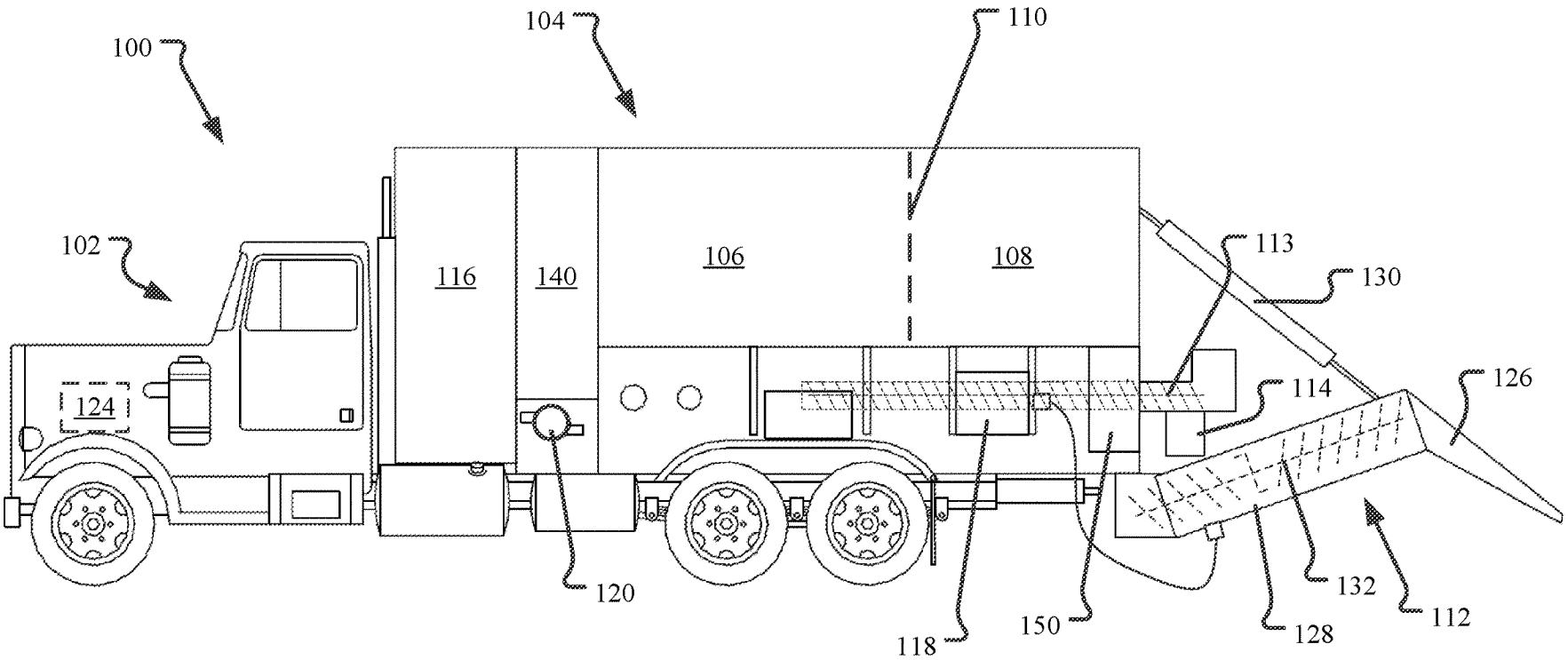
FIGS. 1A and 1B illustrate the driver's and passenger's sides, respectively, of an embodiment of VMPM truck 100.

This disclosure describes volumetric mobile mixer (VMPM) systems and methods for VMPM operation and use. The VMPM is provided with a number of storage compartments (or bins) for liquid or solid ingredients including at least one dedicated powder storage bin, a powder transport system, a dust handling system, a powder/liquid mixing system, a cellular foam generator, a product delivery system, and a controller capable of monitoring the delivery and mixing of each of the ingredients, as well as the discharge of the final product. The controller determines if the proper mixture is being discharged by the VMPM and, if not, alerts the VMPM operator. In an automated embodiment, the VMPM controller is also configured to independently control the delivery and mixing of each of the ingredients, as well as the delivery of the final product. The controller may be designed so that a specific formulation may be selected or input. The controller may also automatically initiate the operation of the various systems in the order and at the moment necessary to deliver the selected product.

Although the designs and technology introduced above and discussed in detail below may be implemented on a variety of mobile platforms (e.g., vehicle, trailer, skid, railcar, marine vessel, etc.), the present disclosure will discuss the implementation of this technology in the form of a VMPM truck in which a VMPM is mounted on a typical truck chassis, as illustrated in FIG. 1. The reader will understand that the technology described in the context of a VMPM truck could be adapted for use with any other mobile platform including a VMPM trailer, a VMPM skid, and a VMPM railcar to name but a few. In addition to terrestrial vessels, VMPM systems could also be provided on marine vessels (e.g., boats, barges, ships, etc.) or aircraft. For example, although it may be cost prohibitive for some applications, a VMPM aircraft could be provided using a helicopter, airship, or transport plane as the mobile platform.

For the purposes of this disclosure, a powder means a substantially dry, solid material having a particle size that will pass through a 200 standard mesh. The word 'substantially' is used herein to remind the reader that in the real world a powder 100% devoid of water is generally not possible. Likewise, some powder material may include some amount of particles, that are larger than 200 mesh in size and still be a flowable powder that can be transported using a screw conveyor system.

Aggregate material, on the other hand, shall refer to solid material in which greater than 90% by weight of the material is larger than, and will not pass through, a 200 standard mesh. Aggregate material is not conducive to transport using a screw conveyor as it is likely to cause damage to the auger or the auger to jam. Rather, aggregate materials are normally transported using a belt or chain conveyor or other mechanisms. Thus, powder storage bins are differentiated from aggregate storage bins in that powder storage bins are provided with a screw conveyor and may also be provided with other powder specific transport equipment such as air slides and bin vibrators.

Figure 1B:
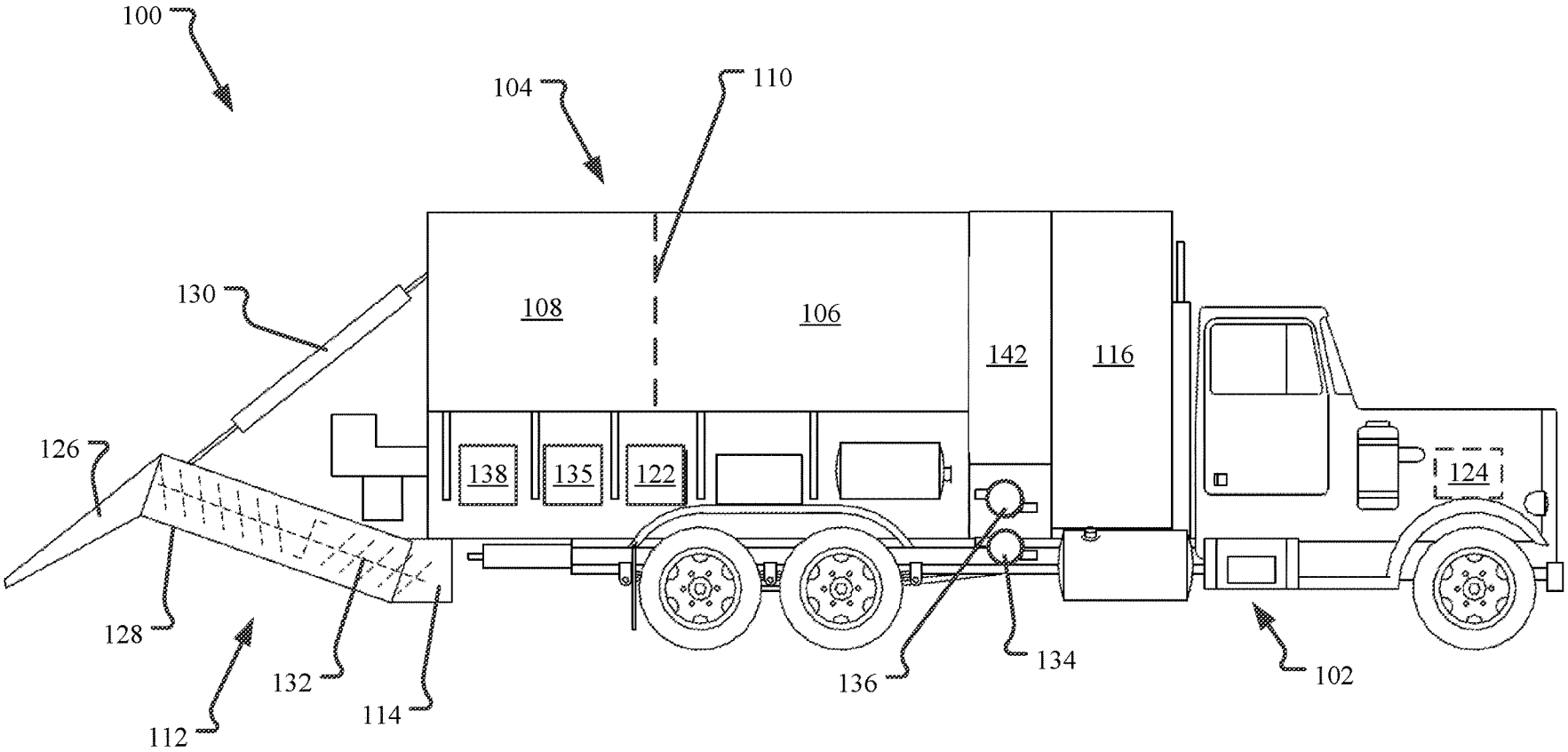

FIGS. 1A and 1B illustrate the driver's and passenger's sides, respectively, of an embodiment of VMPM truck 100. The VMPM truck 100 has two primary components: the truck chassis 102 and the VMPM unit 104. The primary components of the VMPM unit 104, as shown, include two powder storage bins 106, 108, a water storage tank 116, a foaming agent storage tank 122 containing cellular foam solution, a foam generator 118, and a mixing chamber/delivery boom 112 located at the rear of the VMPM truck 100. Optionally, one or more liquid chemical admixture dispensing tanks 135 and one or more dry-hoppers for dry, powdered chemical admixtures or synthetic fibers 138 may also be provided.

In an embodiment, the truck chassis 102 may be a typical heavy-duty, straight-chassis commercial truck as shown. The chassis configuration shown has a single-wheeled, front steering axle and two, dual-wheeled driving axles. In an alternative embodiment, two drop-down single-wheeled, booster axles may be provided to maintain legal axle weights when the ingredient storage bins are fully loaded. A smaller embodiment of a VMPM truck could be mounted on pickup truck chassis while a larger version could be mounted on a larger truck, or a semi-trailer for use with an independent tractor.

In the embodiment shown, the VMPM unit 104 includes two powder storage bins 106, 108. The powder storage bins the bins 106, 108 are configured to receive and hold powder, as defined above, which can then be delivered to a mixing chamber 112 via at least one feed screw conveyor 113 (sometimes also referred to as auger conveyors). In an embodiment, an aggregate storage bin (not shown) may also be provided for handling larger materials unsuitable for use with screw conveyors. For example, in an embodiment the VMPM unit 104 may be used to mix different cementitious powders (cement, flyash, etc.). In an embodiment, the feed screw conveyors 113 are located below the powder storage bins 106, 108 and transport powder to an inlet head 114 above the mixing chamber 112. The bins 106, 108 may be of different sizes and separated by a fixed partition 110. Alternatively, the partition 110 may be removable or may be provided with a sealable access door so that the two powder storage bins 106, 108 can be combined to form a single, larger bin. In one configuration, the two powder storage bins 106, 108 are each provided with an access port for powder to be placed in the bins. As discussed in greater detail in FIG. 2, each bin 106, 108 may be provided with an air slide and configured as a hopper over the feed screw conveyors 113 to ensure consistent flow of the material to the feed screw conveyors.

The VMPM unit 104 is further provided with a raw water storage tank 116. In the embodiment shown in FIG. 1, the water tank 116 is located behind the truck cab, and the powder bins 106, 108 are located behind the water tank 116. The water storage tank 116 provides water to various components including to the mixing chamber 112 and to the cellular foam generator 118. A pump 120 is provided to control the flow and pressure of the water delivery. The pump 120 may be electric, hydraulic, or mechanical as desired. For example, an engine-driven, power take off (PTO) water pump may be used to supply water to the foam generator and mixing chamber. Alternately an electrical water pump could be used to avoid variations in the pump's flowrate due to the truck engine's idle speed variations, potentially providing more consistent volume and pressures.

Various manual and automatic valves may further be provided to control the flow of water to individual components of the VMPM unit 104 as needed. One or more water intakes may be provided to allow the water tank 116 to be filled from any convenient source such as a fire hydrant. Furthermore, the pump 120 may be configurable to allow it to be used to fill the water tank 116 from an external standing water source such as a tank or a pond.

The VMPM truck 100 is further provided with a dust handling system that maintains the mixing chamber 112, the first powder storage bin 106, and the second powder storage bin 108 at a negative pressure relative to atmospheric pressure, while also filtering the air discharged from the VMPM unit 104. The dust handling system includes an air compressor 124, which may be a part of the truck chassis 102 as shown or may be provided as part of the VMPM unit 104, and one or more filtration units. In the embodiment shown in FIGS. 1A and 1B, the filtration unit takes the form of two baghouses 140, 142 located between the water tank 116 and the powder storage bins 106, 108. The operation of the two baghouses and the dust handling system is discussed in greater detail below with reference to FIG. 3.

In the embodiment shown, compressed air is provided with a high capacity (34 cfm), engine-driven, air compressor 124 to provide air to the foam generator 118, as well as the normal air brakes for the chassis 102. An engine-driven, rotary lobe-type, axial-flow blower 134 provides high-volume air flow for the dust handling system, which includes flow through the air-slides in the main powder bins 106, 108 to fluidize and move the powder to the feed screw conveyors 113. A second blower 136, such as an engine-driven radial-blade blower is also provided to provide additional air flow to the dust handling system. An engine-driven, high-performance hydraulic pump and cooling system may be used to provide power to hydraulic motors and cylinders. As discussed above, in alternative embodiments, electric, hydraulic, or mechanical compressors, blowers, or pumps may be substituted for engine-driven units as desired.

In the embodiment shown, the mixing chamber 112 of the VMPM unit 104 also acts as the delivery boom 128 that can be raised, lowered, and/or pivoted side to side as needed by a hydraulic actuation system 130. The angle of the delivery boom 128 is controlled by a hydraulic cylinder, and can be raised to near vertical for road travel, and lowered to an angle below horizontal for operation. A separate hydraulic cylinder may also be provided to control the position of the discharge chute, relative to the delivery boom. Yet another hydraulic cylinder may be provided to swing the delivery boom or delivery chute left and right of center of the VMPM truck 100. In yet another embodiment, two opposing hydraulic cylinders may be provided for horizontal movement of the delivery boom 128.

Above the inlet to the mixing chamber 112 is an inlet head 114 that delivers water from the water tank 116 and powder from the powder bins 106, 108 into the mixing chamber 112. In the embodiment shown, the inlet head 114 is fixed to the VMPM unit 104 above the inlet of the mixing chamber 112. This configuration allows the mixing chamber/delivery boom assembly to pivot about the location of the inlet.

In the embodiment shown, the mixing chamber includes a delivery auger 132 that rotates within the delivery boom 128, which acts as the transport housing. The rotation of the delivery auger 132 both mixes the material delivered into the mixing chamber 112 and also causes the mixing chamber to act a screw conveyor by transporting the mixed material to the delivery chute 126 at the end of the delivery boom 128.

In the embodiment shown, the delivery auger 132 runs most of the length of the mixing chamber 112 and is a single auger that has three different sections, each with a different profile to enhance the mixing of the foam, powder and water. The first section into which the powder and water is received from the inlet head 114 begins the mixing of the two into a slurry and moves the material further into the delivery boom 128. In the embodiment shown, the first section is a standard mixing screw profile. This first section is followed by a mixing paddle section that includes paddles for aggressive mixing of the foam into the slurry formed in the first section. The paddles may be both forward and reversing. The final section is another standard mixing screw profile transports the mixed material to the end of the delivery boom 128 and discharges it to delivery chute 126, from which it falls under gravity to the final delivery point (e.g., a trench). However, in the embodiment shown the final delivery screw section has a different profile than that of the first screw section (e.g., if the first screw section is a right-hand screw at a first pitch, the final screw section may be a right-hand screw of a different pitch).

The VMPM unit 104 is further provided with a cellular foam generator 118. The cellular foam generator 118 receives air from the air compressor 124, a cellular foam solution from the foaming agent storage tank 122, and water from the water storage tank 116 via the pump 120 and generates a flow of foam. The flow of foam is then piped to a location in the mixing chamber 112 between the chamber's inlet and the discharge point at the delivery chute 126, such as to the first screw section of the delivery auger 132 as shown.

A VMPM controller 150 is provided and, in the embodiment shown, is located at the end of the unit near the delivery boom 128 to allow an operator to observe the discharge of the mixed product while controlling the VMPM's operation. In an embodiment, the controller is a general purpose computing device having a user interface and a display, running purpose-written software for receiving the monitored parameters, storing preset operational parameter settings which may include mix formulations, making mix calculations based on the monitored parameters, comparing the monitored parameters and/or calculated mix formulations to preset settings, and displaying information to the operator. In an automated embodiment, the controller 150 may also be programmed to control the valves, pumps, blowers, and other equipment of the VMPM truck 100. The controller 150 may further be provided with a printer for printing receipts and delivery tickets documenting the product delivered during a mix operation.

Gauges and meters are provided on the controller 150 to monitor water flow (e.g., in gallons per minute or GPM), auger speed (e.g., in revolutions per minute or RPM), air pressure (e.g., in pounds per square inch or PSI), and air flow (e.g., in cubic feet per minute CFM) functions. Tachometers on the material conveyance augers provide RPM measurements that allow faster, correct mixture proportions at startup, and minor adjustments to the slurry production. In an embodiment, VMPM units may be controlled with a fixed touch-screen control display and/or flexible cable-connected handset with the following controls: ON-OFF switches that control the feed screw conveyors and main-system ingredient delivery (water, foam generator and inclined powder augers); and a truck engine motor speed control switch (changing from idle to full operation RPM). Momentary toggle switches control the delivery boom 128 raise-lower and swing operations, as well as the final delivery chute 126 raise-lowering.

In an alternative embodiment, in addition to or instead of the handset or fixed touch-screen control display the controller allows for wireless control via an app on a portable, wireless device. Wireless communications may use Bluetooth® or some other communication protocol so that the controller 150 provides a graphical user interface (GUI) to the wireless device (phone, tablet, laptop) for control of the VMPM unit's operation.

Experience has shown that increasing or decreasing the rate of material produced can be predictably accomplished by proportionately increasing the GPM and RPM values; these proportionate adjustments could also be computer-controlled to automatically maintain mixture proportions, when the operator desires to increase or decrease the rate of product produced. Likewise, the totalizing flowmeter on the water line provides a GPM reading for repeatable mixture control, as well as a total water volume provided during mixing. This total water can be used to calculate the total volume of foamed material produced, based on the amount of water in each cubic yard per the laboratory mix design.

Through the VMPM controller 150, the operator controls both mixture production and delivery. The production of these cementitious materials is normally to match a mix design (recipe of materials) that has been pretested in a laboratory for the final strength properties at 28 days, as well as pertinent fresh physical properties, such as unit weight & fluidity. The first step of producing the desired mixture is getting the right proportions of water to powdered materials using the water flowmeter GPMs and the auger speed RPMs of the operator controls. The un-foamed slurry is tested for density, to achieve the correct proportions. A similar process is used to vary the proportions of foam solution, water, and compressed air (pressure in psi and flow in CFMs), to achieve the desired foam density, e.g., from 2 pcf to 3 pcf. In an embodiment, the foam solution is blended into water at a fixed amount such as 1:50 foam solution to water and then the appropriate amount of air is mixed into the foam solution/water mixture. In an alternative embodiment, the water, foam solution, and air may all be mixed at the same time. Then a third step of varying the amount of foam added to the base slurry production is performed to achieve a density within a tolerance allowed from the mix design density; this is known as the foamed density of the final product.

Through the controller 150, an operator may also control delivery of the final product to the desired point of placement, whether that is a trench to fill to grade, a pipe to abandon by filling, or the hopper of a pump truck that will pump the product into its final location. The angle of the mixing chamber/delivery boom assembly affects the efficiency of mixing the product. Some products require a steeper angle to provide more mixing time, while others can mix well at a shallow angle that provides a longer reach for final delivery.

Figure 2:
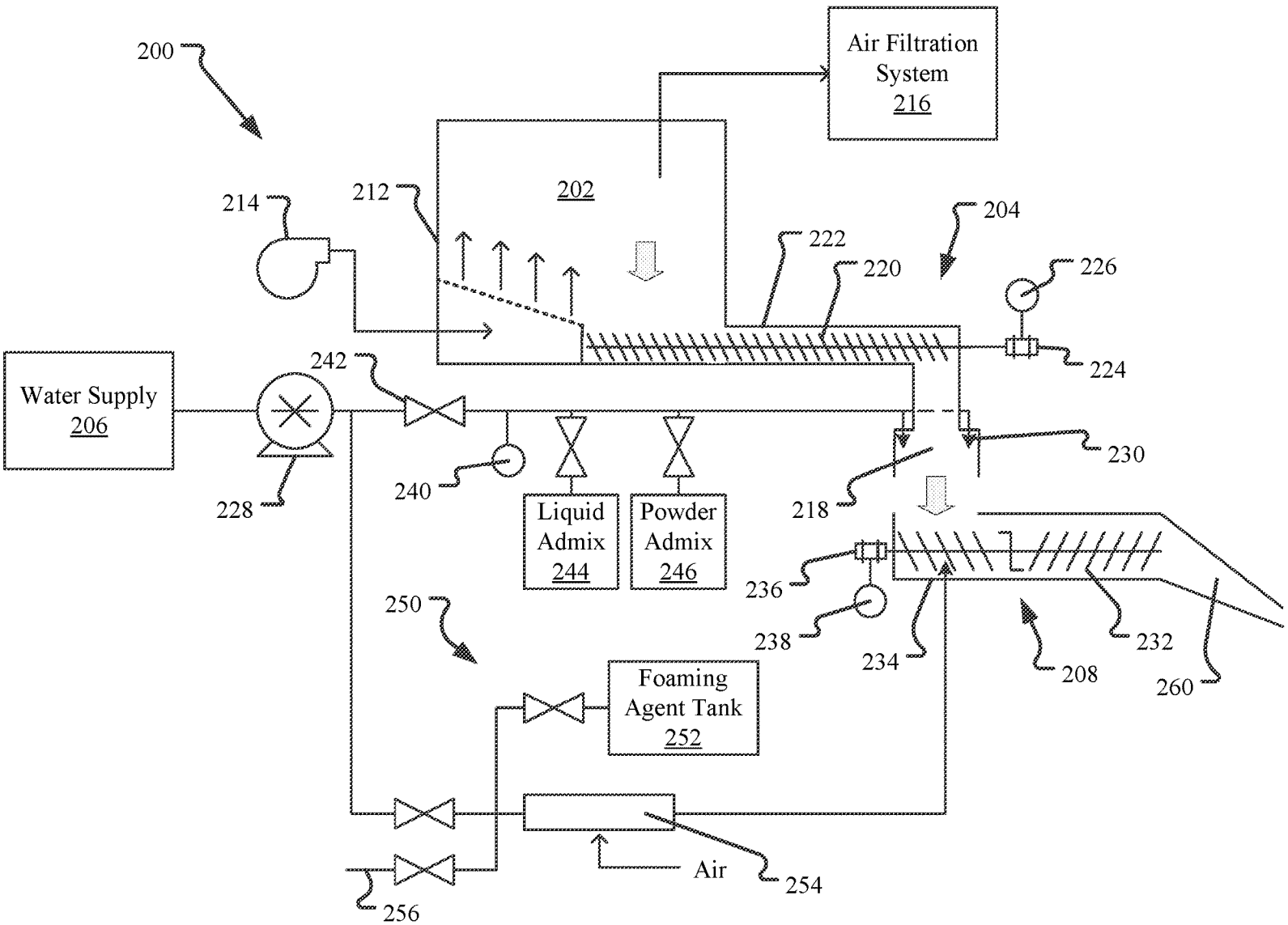
FIG. 2 is a functional schematic illustrating in more detail the components of an embodiment of the materials delivery system.

FIG. 2 is a functional schematic illustrating in more detail the components of an embodiment of the material delivery system. In the embodiment shown, the main components of the powder delivery system 200 are at least one powder storage bin 202, at least one feed screw conveyor 204, a water storage tank 206, a foam generator 210, and a mixing chamber 208. For clarity, FIG. 2 only illustrates one powder storage bin 202, one feed screw conveyor 204 and one water storage tank 206.

The powder storage bin 202, as described above, is designed to hold powder (cement, fly ash, industrial baghouse fines. Other solid aggregates (above 200 mesh) such as commercially-processed sand, commercially-processed gravel, commercially-processed stone, course industrial byproducts such as bottom ash, trench spoils from excavations, screened native soils, etc.) and efficiently deliver the stored material to the feed screw conveyor 204. To achieve this, the powder storage bin 202 may have an internal shape, such as a hopper shape, to allow for efficient dispensing of the stored material. In the powder storage bin 202 shown, an internal air slide 212 is provided within the bin compartment sloped to direct powder on the feed screw conveyor 204. Air slides, which may also be called aeration conveyors or air gravity conveying systems, use a panel porous fabric through which low pressure air is flowed from below to facilitate movement of the solid material along the top surface of the fabric. Air flow (illustrated by the open arrows) through the air slide 212 is provided from a blower 214 or other compressed air source. The combination of the slope of the air slide 212 and the flow of air ensures that even fine powder will consistently flow into the feed screw conveyor 204 during operation. The powder storage bin 202 may also be vibrated to further assist in feeding of the stored material. In an embodiment, the entire bottom of the bin 212 except for the inlet to the feed screw conveyor 204 is made of air slide panels sloping to the feed screw conveyor inlet. Protective, tent-shaped horizontal baffles may be placed over the transfer inlet to the auger 220, to provide a more uniform surcharge of dry material to the auger 220, whether the powder bin 202 is full or near empty, by avoiding the vertical surcharge weight of powder when full.

Providing an air slide 212 is but one way to configure the bin 202 to efficiently deliver stored material to the feed screw conveyor 204. Other passive or active systems for feeding aggregate materials from a storage bin are known in the art and may be used instead of or in addition to the use of the air slide. For example, providing vibrating feeders, screw feeders, paddle feeders, or other such components at the bottom of the bin 202 is another way of achieving consistent aggregate feeding.

As discussed in greater detail below with respect to FIG. 3, the bin 202 may be maintained under negative pressure so that air flow only exits the bin 202 through an air filtration system 216, such as a baghouse as described above.

The feed screw conveyor 204 transports stored material from the bin 202 to the inlet 218 from which it falls into the inlet of the mixing chamber 208. In the embodiment shown, the feed screw conveyor 204 has one or more augers 220 that are exposed to the stored material and are at least partially encased within a transport housing 222 between the location of the bin 202 and the inlet head 218. In an embodiment, a larger bin 202 may be provided with more screw conveyors 204 or with a screw conveyor 204 having multiple augers 220 than a smaller sized bin in order to provide a wider range of total flow rate of stored material from the larger bin. The augers 220 may be slightly inclined downward to assist in the transport of the stored material.

The feed screw conveyor 204 also includes a motor 224 or other driving system that causes the auger 220 or augers 220 to rotate, and thus transport the stored material to the inlet head 218. Using a auger 220 and housing 222 is but one mechanism for transporting material from the bin 202 to the inlet head 218 and any other suitable conveyance mechanism may also be used.

The feed screw conveyor 204 further includes a monitoring device 226 from which the flow rate of the stored material may be determined. In the system shown, the monitoring device is a tachometer 226 that may be a separate unit or may be built into the motor 224. The tachometer 226 monitors the rotational speed of the auger 220 of the conveyor 204 and reports this information to the control system. From the rotational speed, the flow rate of stored material can be determined by the control system. Other types of monitoring devices may be used. For example, a different type of monitoring device 226 may be used if alternative conveyance mechanisms are used.

Systems having multiple powder storage bins 202, such as that shown in FIGS. 1A and 1B, each with one or more feed screw conveyors 204 all feeding into the mixing chamber 208 are possible. Likewise, systems may incorporate an aggregate storage bin and delivery system as well. For example, in the embodiment in FIG. 1, each storage bin 202 may be provided with its own feed screw conveyor 204 including independent augers 220, housings 222, motors 224 and tachometers 226. In this way, multiple, different powders may be mixed in any ratio by the same VMPM unit. Embodiments having two (as shown in FIGS. 1A and 1B), three, or more bins 202 are possible. In such a multiple powder bin embodiment, the various augers 220 may be powered by a single motor 224 that is connected to an adjustable chain & sprocket system. The ratios of the sprockets used on the individual augers then would determine the relative rotational speed of each auger 220 based on the rotational speed of the motor 224. Alternatively, separate and independent motors 224 may be used for each feed screw conveyor 204 or, even, for each auger 220 for even more operational flexibility.

Returning now to FIG. 2, in the powder delivery system 200 as shown, water is also delivered to the inlet head 218 by the pump 228. In the embodiment shown, a set of nozzles 230 in a ring around the inlet head 218 is used for water injection such that the powder from the bin 202 falls through the center of a roughly cylindrical spray of water, preventing powder from building up on the sides of the inlet to the mixing chamber 208 during continuous mixing operations. A monitoring device, such as a flowmeter 240, may be provided at the pump outlet or before the nozzles to monitor the flow rate of water into the inlet head 218. An automatic and/or manual valve 242 may be provided to control the flow of water into the inlet head as shown. In an embodiment, electric over hydraulic control valves provide better operator convenience than typical mechanical valves used for controlling hydraulic flow on other types of trucks and equipment.

The mixing chamber 208 further includes a delivery auger 232 within a housing that also acts as the delivery boom 234. In the embodiment shown, the delivery auger 232 has a three-section profile (as described above). A delivery auger motor 236 or other driving system is provided to rotate the delivery auger 232, and thus mix, transport and discharge the mixed material to the outlet at the delivery chute. Using a auger 232 within the delivery boom 234 is but one mechanism for mixing and transporting material and any other suitable mixing and conveyance mechanism may also be used.

The delivery boom 234 may be provided with several sectional, removable top covers to allow easy access to the delivery auger 232 and mixing chamber 208. When the covers are in place, they create a sufficient fit so as to allow the delivery boom to be maintained under negative air pressure to prevent any fugitive dust from escaping during mixing. In an embodiment, a flexible hose (not shown) connects the interior of the delivery boom 234 to the air filtration system 216 where dust is collected and returned to the bin 202.

A monitoring device 238 from which the flow rate of the mixed material may be determined may also be provided. In the system shown, the monitoring device is a tachometer 238 that may be a separate unit or may be built into the motor 236. The tachometer 238 monitors the rotational speed of the auger 232 and reports this information to the control system. From the rotational speed, the flow rate of stored material can be determined by the control system. Other types of monitoring devices may be used. For example, a different type of monitoring device 238 may be used if alternative conveyance mechanisms are used in the mixing chamber 208.

In yet another embodiment, no monitoring device 238 may be used. Rather, the flow rate of the final mixed product may be determined by the controller using a mass balance by adding in the flow rates of powder from the individual bin or bins 202 and the flow rate of water injected.

The powder mixing system 200 is further provided with a cellular foam generator 250. The cellular foam generator 250 includes a foaming agent storage tank 252, an air-liquid mixer 254, and valves and controls for mixing the cellular foam solution into a stream of water and then to mix compressed air into the cellular foam solution/water mixture in the air-liquid mixer 254, which may also be referred to as a foaming wand 254. The foam generator 250 may be provided with multiple foaming wands 254 of different sizes, depending on the rate of cellular foam needed for a specific final product. In an embodiment, a VMPM may create approximately 60 cubic yards per hour (cy/h) of base slurry, and the air content created by the foam can vary from approximately 10% (minimal air content) to 75% for 30 pound per cubic foot (pcf) cellular grouts. For full production rates of low-density products with higher air contents, an external, high-pressure (e.g., 75 psi, 100 psi, 200 psi, or more) air compressor can be coupled to the powder mixing system via a valved, auxiliary compressor connection 256.

The output of the air-liquid mixer 254 is a stream of foam. In an embodiment, the air is received from an air compressor or blower. The source may be the truck's air compressor 124, or may be a different source such as the external, high-pressure air compressor discussed above. The cellular foam solution from the foaming agent storage tank 252 and water from the water storage tank 206 may be mixed in a simple T fitting or may be mixed using a more sophisticated system such as a dosimetry system. The flow of foam is then piped to a location in the mixing chamber 208 between the point at which the powder/water is received and the discharge point at the delivery chute 260, such as to the first screw section of the delivery auger 232 as shown.

The flow rate of the foam may be monitored by a monitoring device, such as a mass flowmeter, or may be determined based on a flow rate of one or more of the three ingredients. For example, in an embodiment, the flow rate of the water into the foam generator 250 is monitored using a flowmeter (not shown) and the total flow of foam is determined from that input alone based on the known mixing settings of the other ingredients.

In some cases, it is desirable for a VMPM to be able to also mix liquid or dry admixtures into the final mixture. Such admixtures include chemicals that act as set retarders, water reducers, viscosity modifiers, and accelerants. FIG. 2 illustrates an optional liquid admixture dosing system 244 and an optional dry solid admixture dosing system 246 as part of the powder delivery system 200. The admixture dosing system 246 may include one or more liquid chemical admixture dispensing tanks 244 as well as the valve and controller for appropriately dosing the liquid admixture into the water supplied to the inlet head 218. Such liquid admixtures include liquid citric acid. Likewise, one or more dry-hoppers 246 for dry, powdered chemical admixtures or synthetic fibers 138 may also be provided. Examples of dry admixtures include dry citric acid, sodium bicarbonate, sodium carbonate, or borax. Flowmeters or dosimeters may also be provided to monitor the admixture flow.

The water storage tank 206 may be of any suitable type. The VMPM unit can refill the water tank 206 in a variety of ways (via a water hydrant connection during continuous mixing operations, separate water trucks, pumped from a pond, or stationary water tanks).

Figure 3:
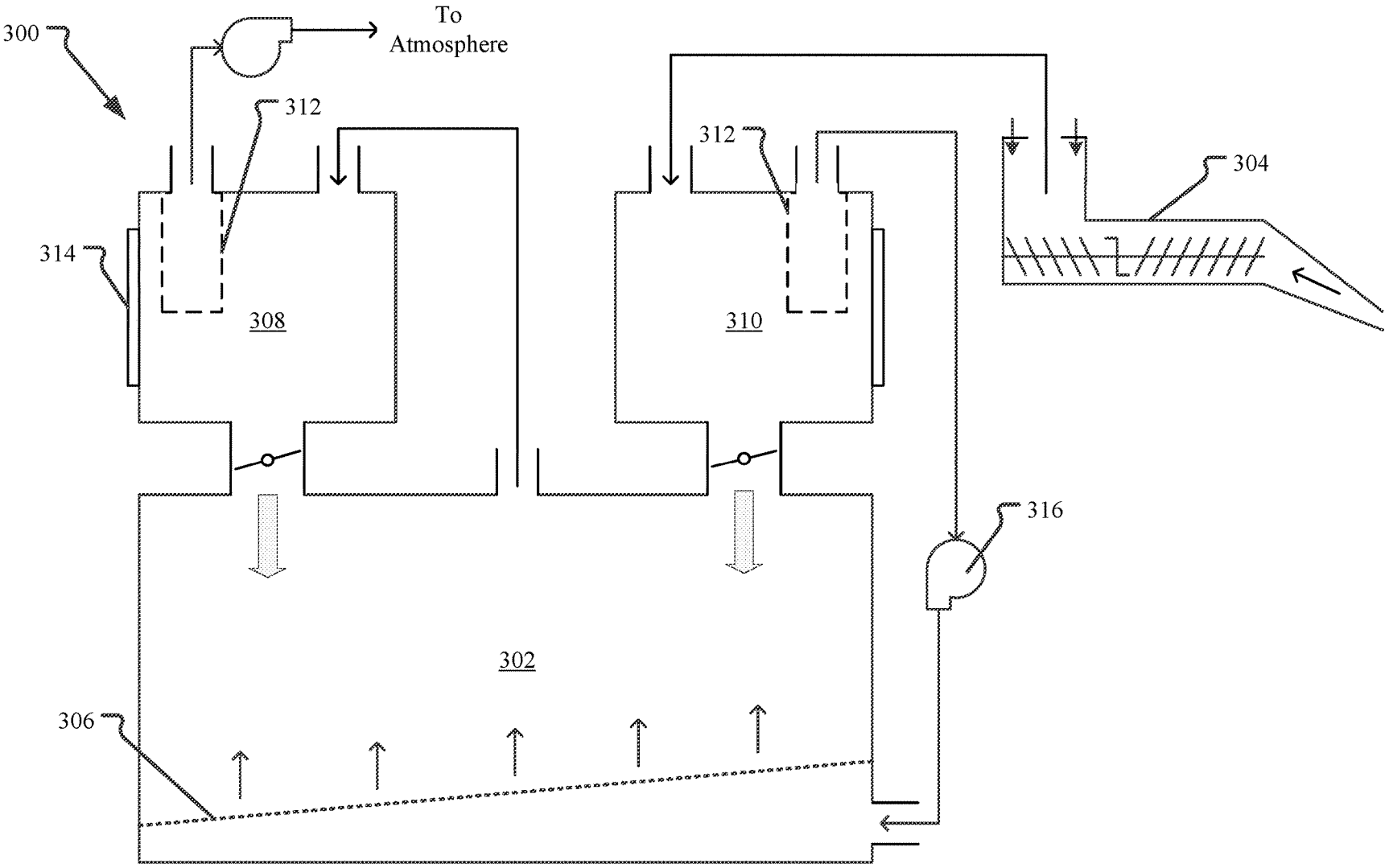
FIG. 3 is a functional schematic illustrating in more detail the components and operation of the dust handling system.

FIG. 3 is a functional schematic illustrating in more detail the components and operation of the dust handling system. As described above, the dust handling system 300 maintains the powder bin or bins 302, and delivery boom 304 under negative pressure as well as providing air flow to the air slides 306. The dust handling system 300 also filters the air to prevent dust emissions during operation and returns captured powder to the bins 302.

In the system 300 shown, two baghouses, a primary baghouse 308 and a secondary baghouse 310, are provided. Each baghouse is illustrated as a chamber with an inlet, a filtered air outlet, and a captured powder return outlet provided with a valve. The primary baghouse 308 captures powder dust generated in the powder storage bin or bins 302 by the air-slides 306 and when the bin 302 is refilled. In an embodiment, captured powder is returned to the storage tank by manually activating its own butterfly valve. Alternatively, the return could be automated based on the amount of dust collected.

The secondary baghouse contains captured dust from the delivery boom. In an embodiment, a flexible hose connects one or more locations on the delivery boom 304 to the secondary baghouse 310. In the embodiment shown, the secondary baghouse 310 also includes a butterfly valve that can be manually activated, releasing the captured fly-ash or cement particles back into the powder storage bins 302.

Filtration in the baghouses 308, 310 may be provided by any suitable filter means. In an embodiment, filtration is provided by some number of cartridge filters 312 that can be easily removed when fouled via an access panel 314 on each baghouse. The size of the baghouses and number and size of the cartridge filters 312 in each may vary based on the anticipated flow rate and dust loading each baghouse is subjected to. For example, in an embodiment the primary baghouse 308 is provided with 36 filter cartridges and the secondary baghouse 310 is provided with nine filters. Alternatively, a filter bags or any other filter, as is known in the art, may be utilized.

In operation, negative pressure is applied to the delivery boom 304 by the suction from the first blower 316 through the secondary baghouse 310. The first blower 316 draws air through the filtered outlet of the secondary baghouse 310. The inlet of the secondary baghouse 310 is connected to the delivery boom 304, thus drawing dust-laden air from the delivery boom 304. The output of filtered air from secondary baghouse 310 is drawn into the first blower 316 and then delivered to the air slides 306 in the VMPM unit and, through the air slides 306, into the powder storage area of the bins 302.

The powder storage bins 302 are maintained at a negative pressure by the second blower 318 through the primary baghouse 308. The second blower 318 draws air through the filtered outlet of the primary baghouse 308. The inlet of the primary baghouse 308 is connected to the one or more outlets of the powder storage bins 302, thus drawing air from the bins. The output of filtered air from the second blower 318 may be delivered to the atmosphere as shown.

The blowers 316, 318 in the dust handling system 300 may be of any suitable blower or compressor type and may be powered by any available source (e.g., engine-driven, electrical, etc.). In an embodiment, the first blower 316 is a rotary-lobe type axial-flow blower and the second blower is a radial-blade, direct-drive blower. The air flow in the blowers may be controlled by the VMPM controller and varied, manually or automatically, as needed to prevent dust emissions and ensure proper operation of the air slides 306.

The dust handling system 300 allows the powder storage bins 302 of the VMPM units to be refilled with powder during operation. Powder from an external source, such as a bulk delivery truck, may be pneumatically transferred from the source into the VMPM's powder storage bins 302, while continuously mixing and delivering the desired cementitious foamed product.

The dust handling system 300 may also be provided with a manual or automated system for clearing the filters during operation. In such an embodiment, valving and connecting air lines may be provided to allow filtered air to be backflushed through the filter media in order to clear the filter media of surface dust that may be fouling the media. Backflushing may include using a valve to block flow out of one or more filters and initiating a counter flow of pressurized air through the filter media into the baghouse. Backflushing may be done based on elapsed time or in response to loss in performance such as a detected reduction in air flow through the baghouse or increased pressure drop across the filter media. The backflushing operation may be done manually or may be controlled by the controller. Filters may be backflushed separately or in groups. In an embodiment, less than all of the filters in a baghouse are backflushed simultaneously so that the baghouse may remain in operation during the backflushing operation. If automated using the controller, the controller may backflush each individual filter in a sequence in response to elapsed time, a detected drop in air flow, or a detected increase in pressure across the filter. For example, the controller may automatically backflush each filter sequentially for a minute after every 30 minutes or hour of product delivery without interrupting the delivery operation.

Figure 4:
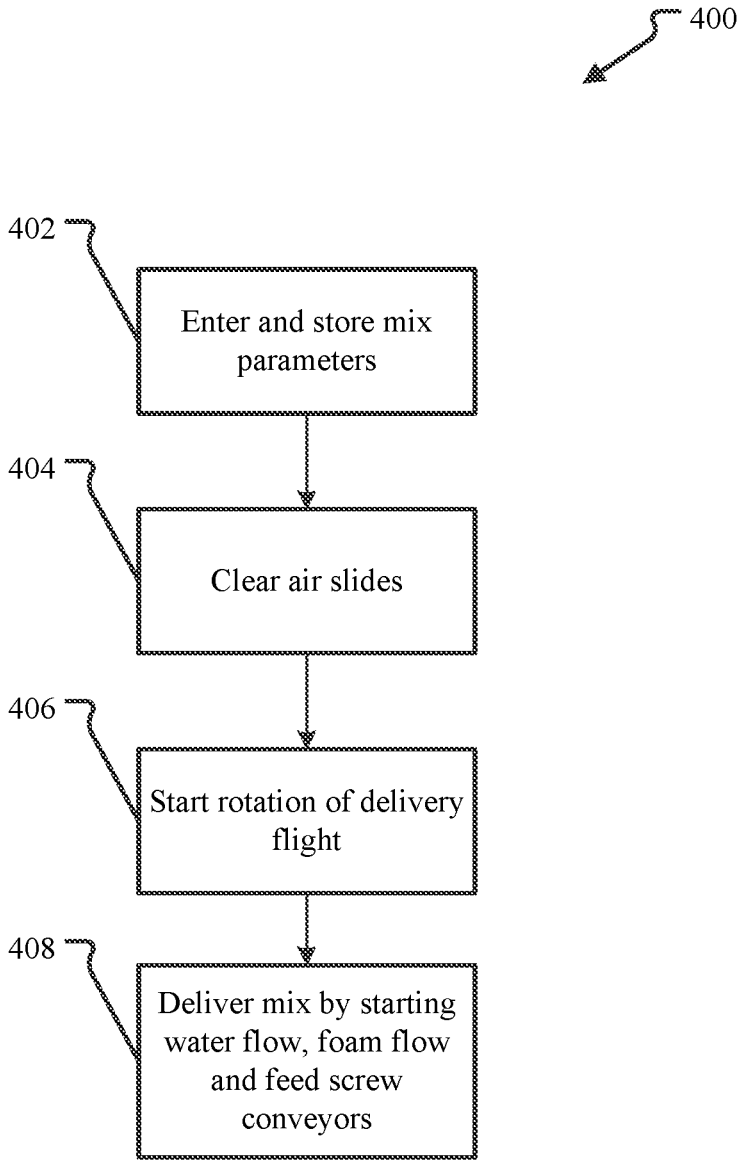
FIG. 4 is a block flow diagram of a method of starting up the mixing equipment of the VMPM.

FIG. 4 is a block flow diagram of a method of starting up the mixing equipment of the VMPM. The method of starting up the system is of particular importance to prevent clogging of the delivery boom with poorly mixed material. The method 400 may be done manually through the controller or may be automated so that it can be performed in response to a single input from the operator.

In the embodiment shown, the startup method 400 begins with entering and storing information about the mix design, or target formulation, to be delivered by the VMPM in a mix design storing operation 402. In the mix storing operation 402 the operator enters and stores the necessary parameters which may include a design name, delivery rate for each powder (which may be entered as a rate or as a rotational speed for each feed screw conveyor), delivery rate for the water (which may be entered as flow rate or as a powder/water ratio from which the controller calculates the necessary flow rate), and the delivery rate of the foam (which may be entered as a flow rate or as a target density of the final mix product from which the foam flow rate is calculated by the controller). For example, in an embodiment a sand flow rate, a flyash flow rate, a cement flow rate, a water flow rate, and a foam flow rate may be entered and stored as a particular mix design. In addition, if provided with admixture systems the entered parameters may also include the admixture flow rate or rate for each admixture to be provided.

In an embodiment, the parameter entry may include an identification of what type of solid material (cement, sand, peagravel, flyash, etc.) is in each bin. This information may be used by the controller to determine the flow rate of the material from the rotational speed of the feed screw conveyors.

The equipment of the VMPM is started up as follows. As one of the first steps, the air slides are cleared in a clear air slide operation 404. In this operation, the flow rate of air through the air slides in the powder storage bins is briefly increased to high level. In an embodiment, the air flow is raised to a level sufficient to fluidize the powder in the bins which may have become packed down by travel. In an alternative embodiment, the air flow may be increased to some threshold amount that has been previously determined to be effective at clearing the air slides for a particular stored material. The high air flow may be maintained for some predetermined amount of time such as 5 seconds. The air flow level is then returned to a standard operating level for the rest of the startup and for delivery.

The startup operation also includes starting rotation of the delivery auger before any of the feed screw conveyors begin operation. The rotation of the delivery screw auger is initiated at the stored rotational speed in a delivery auger rotation operation 406. This may be done either before, during, or after the clear air slide operation 404.

Following both the delivery auger rotation operation 406 and the clear air slide operation 404, the water flow, foam flow, and the rotation of the feed screw conveyors for the powders to be delivered to the mixing chamber are started in a mix delivery operation 408. Within the mix delivery operation 408, there may be preferential order of starting each flow and screw rotation, or all may be started at the same time. For example, water flow to the inlet head may be started first, then the feed screw conveyors may be started, then the foam flow may be started.

In an alternative embodiment of the startup method 400, the water flow to the inlet head may be initiated as a separate start water flow operation (not shown) that may occur at any time before the mix delivery operation 408.

In an automated version, a single user input to the controller may initiate the sequential performance of the clear air slide operation 404, delivery auger rotation operation 406, and the mix delivery operation 408. In this embodiment, the controller retrieves the settings from the controller's memory or calculates from the stored information the appropriate settings for each of the components.

Figure 5:
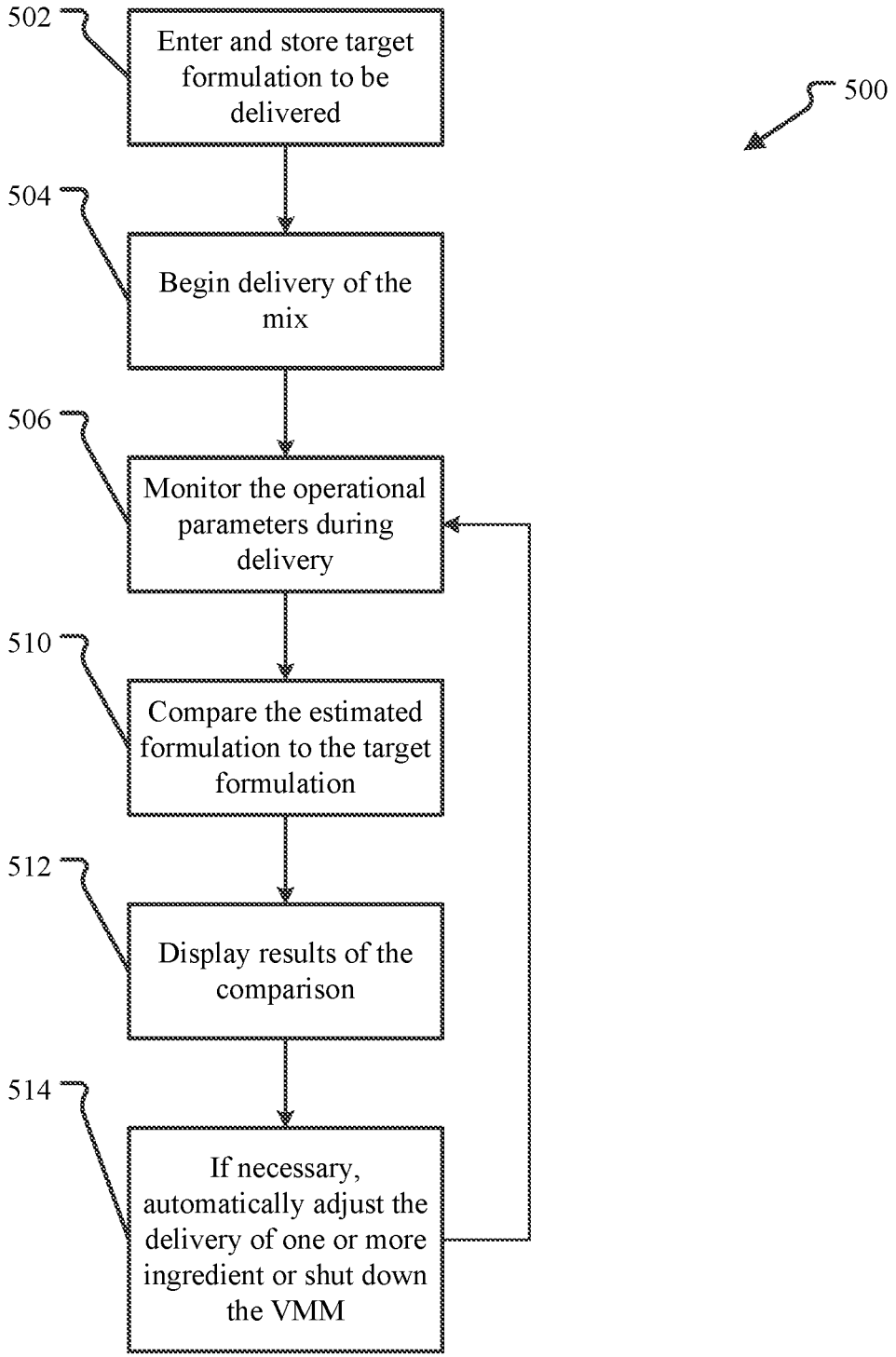
FIG. 5 is a block flow diagram of a method of monitoring and reporting on the delivery of the mix product.

FIG. 5 illustrates another function of the controller: monitoring and reporting on the delivery of the mix product. The monitoring method 500 of FIG. 5 also begins with a mix design storing operation 502 in which the target settings for various components are stored, such the target speeds for the various augers, the target water flow rate, and a target foam flow rate, or equivalent settings. For example, in an embodiment the settings necessary to achieve a target formulation to be discharged by the VMPM are entered and stored. Alternatively, the parameters necessary for the target formulation to be determined by the controller may be entered and stored. The VMPM is then started, such as by the method of FIG. 4, and delivery of the mix begins in delivery operation 504.

During delivery, a monitoring operation 506 is repeatedly performed in which the operational parameters of the VMPM are determined from data obtained from the various monitoring devices and components. Such operational parameters include the rotational speeds of the feed screw conveyors, the flow rate of water delivered to the mixing chamber, and the flow rate of foam delivered to the mixing chamber (or some other parameter from which the flow rate of foam may be determined by the controller).

Next, the monitored operational parameters are compared to the target settings in a comparison operation 510. The results of the comparison are then displayed to the operator by the controller in a display results operation 512. The display results operation 512 may include displaying status messages such as alarms or indications of how close the monitored parameters are to the target settings. For example, in an embodiment, the color green may be prominently displayed when the comparison of the monitored parameters and the target settings indicates that they deviate by less than a specified amount from the target settings, essentially indicating that the delivered product is within the specification for the job. A yellow color may be displayed when the comparison of the monitored parameters and the target settings indicates that they deviate by less than a larger threshold amount and a red color may be displayed when they deviate by more than the larger threshold.

The display results operation 512 may also display other information based on the comparison such as a recommendation to increase the flow of water, a recommendation to decrease the flow of water) a recommendation to increase the flow of foam, and a recommendation to decrease the flow of foam. Likewise, recommendation to adjust one or more of the rotation speeds of the augers in the screw conveyors or the angle of the delivery boom may be displayed.

In an automated system, an automatic intervention operation 514 may also be performed. In this embodiment, the controller, based on the results of the comparison, may automatically adjust a flow rate or rotational speed. Alternatively, the controller may automatically turn off one or more components, such as the feed screw conveyors in the event that the estimated formulation is way off or the controller detects that one of the ingredients has been used up.

Depending on the embodiment, a VMPM may be used to deliver any one of the flyash and other powder-ingredient compositions described in U.S. Pat. Nos. 8,747,547; 8,882,905; and 9,376,343, and U.S. patent application Ser. No. 15/155,623, which patents and application are hereby incorporated by reference herein.

In an alternative embodiment of the method 400, the controller may calculate an estimate of the formulation being discharged, based on the monitored operational parameters. This is an estimate of what is actually being discharged by the VMPM in real time. Additional data from other monitoring devices, such as a density monitor may be used as part of this calculation. In this embodiment, the calculated estimate may be compared to a target formulation by the controller and the controller may automatically adjust auger speeds and flow rates in response to the comparison.

It will be clear that the systems and methods described herein are well adapted to attain the ends and advantages mentioned as well as those inherent therein. Those skilled in the art will recognize that the methods and systems within this specification may be implemented in many manners and as such is not to be limited by the foregoing exemplified embodiments and examples. In other words, functional elements being performed by a single or multiple components, in various combinations of hardware and software, and individual functions can be distributed among software applications at either the client or server level. In this regard, any number of the features of the different embodiments described herein may be combined into one single embodiment and alternate embodiments having fewer than or more than all of the features herein described are possible.

While various embodiments have been described for purposes of this disclosure, various changes and modifications may be made which are well within the scope of the technology described herein. For example, a VMPM unit for mixing three different powders could be provided with three powder storage bins and at least one feed screw conveyor for each bin.

Numerous other changes may be made which will readily suggest themselves to those skilled in the art and which are encompassed in the spirit of the disclosure and as defined in the appended claims.

What is claimed is:

1. A volumetric mobile powder mixer comprising:

a mobile platform that supports:

a mixing chamber having an inlet and an outlet;

an inlet head fixed above the inlet of the mixing chamber, wherein the mixing chamber is pivotable relative to the inlet head, and wherein the inlet head has a plurality of water injection nozzles arranged in a ring around the inlet head, the plurality of water injection nozzles and the inlet head extending in a vertical direction on the mobile platform;

at least one powder storage bin configured to receive and hold at least one powder;

at least one feed screw conveyor configured to deliver the at least one powder from the at least one powder storage bin to the inlet head;

an air compressor configured to generate a flow of air;

a foaming agent storage tank configured to receive and hold a cellular foam solution;

a cellular foam generator;

a water storage tank configured to deliver water to the plurality of water injection nozzles at the inlet head and water to the cellular foam generator; and a delivery auger at least partially disposed within the mixing chamber, wherein the delivery auger extends from the inlet towards the outlet of the mixing chamber, wherein the delivery auger is configured to mix the at least one powder and the water to generate a mixture and discharge the mixture from the outlet, and wherein the cellular foam generator is configured to receive the flow of air from the air compressor, the cellular foam solution from the foaming agent storage tank, and the water from the water storage tank and generate a flow of foam therefrom, and wherein the cellular foam generator delivers the flow of foam to the mixing chamber at a location proximate the inlet.

2. The volumetric mobile powder mixer of claim 1, wherein the mobile platform is mounted on a truck chassis.

3. The volumetric mobile powder mixer of claim 1, wherein the at least one powder storage bin comprises a partition configured to separate the at least one powder storage bin into a first powder storage bin and a second powder storage bin.

4. The volumetric mobile powder mixer of claim 1, wherein the at least one powder storage bin comprises an air slide configured to deliver the at least one powder to the at least one feed screw conveyor.

5. The volumetric mobile powder mixer of claim 4, wherein the air slide includes a porous fabric configured to receive air from the air compressor.

6. The volumetric mobile powder mixer of claim 1, further comprising a dust handling system configured to maintain one or both of the at least one powder storage bin and the mixing chamber under negative pressure relative to atmospheric pressure.

7. The volumetric mobile powder mixer of claim 6, wherein the dust handling system includes a first baghouse configured to capture dust generated in the at least one powder storage bin and a second baghouse configured to capture dust generated in the mixing chamber.

8. The volumetric mobile powder mixer of claim 1, further comprising a delivery chute coupled to the outlet of the mixing chamber and a hydraulic actuation system configured to control the position of the delivery chute relative to the at least one feed screw conveyor.

9. The volumetric mobile powder mixer of claim 1, further comprising:

a tachometer configured to monitor a rotational speed of the at least one feed screw conveyor;

a flowmeter configured to monitor a flow rate of water delivered to the mixing chamber; and a controller coupled in communication to the tachometer and the flowmeter, wherein the controller is configured to control the mixture generated at the mixing chamber by selectively adjusting the rotational speed of the at least one feed screw conveyor and the flow rate of water.

10. The volumetric mobile powder mixer of claim 9, wherein the controller is coupled in communication to the cellular foam generator and is configured to control proportions of the flow of air from the air compressor, the cellular foam solution from the foaming agent storage tank, and the water from the water storage tank.

11. A volumetric mobile powder mixer truck comprising:

a truck chasses; and a volumetric mobile powder mixer supported on the truck chasses, wherein the volumetric mobile powder mixer includes:

a mixing chamber having an inlet and an outlet;

at least one powder storage bin configured to receive and hold at least one powder;

a dust handling system configured to maintain both of the at least one powder storage bin and the mixing chamber under negative pressure relative to atmospheric pressure, wherein the dust handling system includes a first baghouse configured to capture dust generated in the at least one powder storage bin and a second baghouse configured to capture dust generated in the mixing chamber, and wherein the first baghouse and the second baghouse are in fluid communication with one another such that filtered air discharged from the second baghouse is drawn into the first baghouse prior to being expelled to the atmosphere;

at least one feed screw conveyor disposed at least partially below the at least one powder storage bin and having an inlet head positioned above the inlet of the mixing chamber, wherein the at least one feed screw conveyor is configured to deliver the at least one powder from the at least one powder storage bin to the mixing chamber at the inlet, and wherein the inlet head has one or more water injection nozzles;

a water storage tank configured to deliver water to the one or more water injection nozzles;

a hydraulic actuation system coupled to the mixing chamber and configured to control the position of the outlet relative to the inlet head; and a delivery auger at least partially disposed within the mixing chamber, wherein the delivery auger extends from the inlet towards the outlet of the mixing chamber, and wherein the delivery auger is configured to mix the at least one powder and the water to generate a mixture and discharge the mixture from the outlet.

12. The volumetric mobile powder mixer truck of claim 11, wherein the inlet head channels the at least one powder to the inlet of the mixing chamber via gravity, and the one or more water injection nozzles are positioned at least partially around the inlet head.

13. The volumetric mobile powder mixer truck of claim 11, wherein the mixing chamber is pivotable about the inlet relative to the inlet head.

14. The volumetric mobile powder mixer truck of claim 11, wherein the inlet of the mixing chamber is open to the atmosphere.

15. The volumetric mobile powder mixer truck of claim 11, wherein the volumetric mobile powder mixer further includes an admixture dosing system configured to mix one or more admixtures into the mixture of the at least one powder and the water.

16. The volumetric mobile powder mixer truck of claim 15, wherein the admixture dosing system is a liquid admixture dosing system that introduces the admixture into the water supplied to the one or more water injection nozzles.

17. The volumetric mobile powder mixer truck of claim 11, wherein the volumetric mobile powder mixer further includes an air slide disposed within the at least one powder storage bin and configured to direct the at least one powder onto the at least one feed screw conveyor.

18. The volumetric mobile powder mixer truck of claim 11, wherein the dust handling system is configured to return captured powder to the at least one powder storage bin.

19. The volumetric mobile powder mixer truck of claim 11, wherein the volumetric mobile powder mixer further includes:

an air compressor configured to generate a flow of air;

a foaming agent storage tank configured to receive and hold a cellular foam solution; and a cellular foam generator, wherein the water storage tank is configured to deliver water to the cellular foam generator, wherein the cellular foam generator is configured to receive the flow of air from the air compressor, the cellular foam solution from the foaming agent storage tank, and the water from the water storage tank and generate a flow of foam therefrom, and wherein the cellular foam generator delivers the flow of foam to the mixing chamber at a location proximate the inlet.

* * * * *